US005954619A

United States Patent [19]

Petrone

[11] Patent Number: 5,954,619

[45] Date of Patent: Sep. 21, 1999

[54] APPARATUS FOR STORAGE AND PRESENTATION OF EXERCISE DUMBBELLS

[76] Inventor: Charles M. Petrone, 1436 Kenton Way, Knoxville, Tenn. 37922

[21] Appl. No.: 09/028,619

[22] Filed: Feb. 24, 1998

[51] Int. Cl.[6] ..... A63B 21/078

[52] U.S. Cl. ..... 482/104; 482/108; 482/106

[58] Field of Search ..... 482/104, 108, 482/106, 94, 142; 297/316, 320, 363, 364, 378.12

[56] References Cited

U.S. PATENT DOCUMENTS

| | | | |
|---|---|---|---|
| 4,477,074 | 10/1984 | Bushnell . | |
| 5,141,480 | 8/1992 | Lennox | 482/104 |
| 5,281,193 | 1/1994 | Colbo, Jr. . | |
| 5,411,459 | 5/1995 | Hayden | 482/104 |
| 5,472,397 | 12/1995 | Ammoscato et al. . | |
| 5,616,108 | 4/1997 | Hayden . | |
| 5,725,460 | 3/1998 | Marsh | 482/104 |
| 5,772,561 | 6/1998 | Hayden | 482/106 |

*Primary Examiner*—Jerome Donnelly
*Attorney, Agent, or Firm*—Paul E. Hodges

[57] ABSTRACT

Apparatus for use in the storing of a dumbbell in position for presentation to a user at a desired height of the dumbbell for commencement of an exercise routine. The apparatus includes an upright standard and a sleeve slidably mounted on the standard and positionable at different heights from the floor. A pair of cradles are hingedly mounted to the sleeve for movement between a dumbbell presentation attitude and an out-of-the-way attitude. The cradles are spaced apart from one another and each is designed to receive therein one end of a dumbbell with the bar member of the dumbbell spanning the open space between the cradles and in position to be grasped by the user's hand inserted into the open space. The cradles are biased toward an upward and inward position toward the standard where they are out of the way of the user performing their exercise routine. Likewise, there may be substituted closed end bores in the standard for the through openings depicted and described herein.

9 Claims, 5 Drawing Sheets

APPARATUS FOR STORAGE AND PRESENTATION OF EXERCISE DUMBBELLS

FIELD OF INVENTION

This invention relates to apparatus for holding dumbbells, and particularly to apparatus for positioning dumbbells in a ready position for grasping by a user at the commencement of an exercise routine.

BACKGROUND OF INVENTION

In the prior art, racks for dumbbell storage and/or transportation are well known. At least one prior art device has been proposed for storing dumbbells in a ready position for the commencement of an exercise routine. This device comprises a swinging holder which is mounted along each of the opposite sides of a conventional exercise bench. Each holder receives one dumbbell and is movable from an "out of the way" position relative to the bench to a position contiguous to the side of the bench where the user can readily grasp a dumbbell for the commencement of an exercise routine. To swing the holder into position for the user to grasp a dumbbell held in the holder, requires the user to utilize their foot to actuate a cable system which pulls the holder from its "out of the way" position into the desired contiguous position with respect to the exercise bench. This device is both cumbersome and costly to manufacture.

One theory for developing various muscle groups of the human body teaches the use of dumbbells as the sole device necessary for achieving the desired result of well-toned and strong muscle groups. In exercising with dumbbells, it is most common for the dumbbell(s) to be initially stored in a rack which is relatively close to floor level. At the commencement of an exercise routine, the user must reach down, grasp a dumbbell in one or both of their hands, and thereafter lift the dumbbell to a starting position. This lifting of the dumbbell(s) to the starting position consumes energy which more desirably should be used in performing the exercise movements.

It is an object of the present invention to provide apparatus which holds a dumbbell in a ready attitude, that is, at a predetermined height and orientation relative to the user, for the commencement of an exercise routine employing the dumbbell held in the hand of the user.

Other objects and advantages of the present invention will be apparent to a person skilled in the art and given the present disclosure, including the claims and drawings in which:

SUMMARY OF INVENTION

In accordance with the present invention there is provided an upright standard and a sleeve encompassing the perimeter of the standard and being slidable along the length of the standard. A pair of interconnected cradles for receiving and storing a pair of dumbbells at a ready position (height and location relative to the user) for commencement of an exercise routine are mounted to the sleeve for hinged movement between an extended dumbbell presentation attitude and a retracted out-of-the-way attitude that is assumed automatically upon removal of the dumbbell from the cradles. A biasing force is applied to the cradles to bias the cradles toward their out-of-the-way attitude. In one embodiment, this biasing force is supplied by means of a gas spring. In one embodiment, the sleeve is secured in a selected position along the length of the standard as by a pin insertable in at least one of a plurality of receptacles or through openings suitable for receipt of the pin. These receptacles are spaced apart from one another along at least a major portion of the length of the standard, preferably by equal distances. In accordance with another aspect of the present invention, the cradles are locked against hinged movement thereof as by a pin or similar device which locks the cradles in their extended attitude relative to the sleeve.

Detailed Description of Invention

Figure 2:
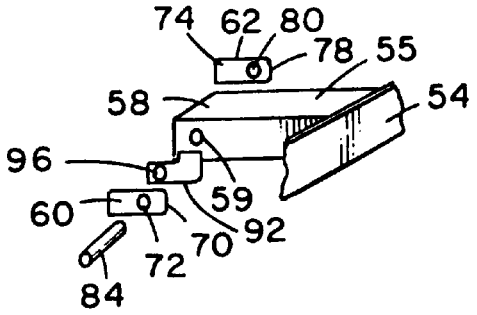
FIG. 2 is a fragmentary partially exploded view of a cradle mounting arm.
Figure 1:
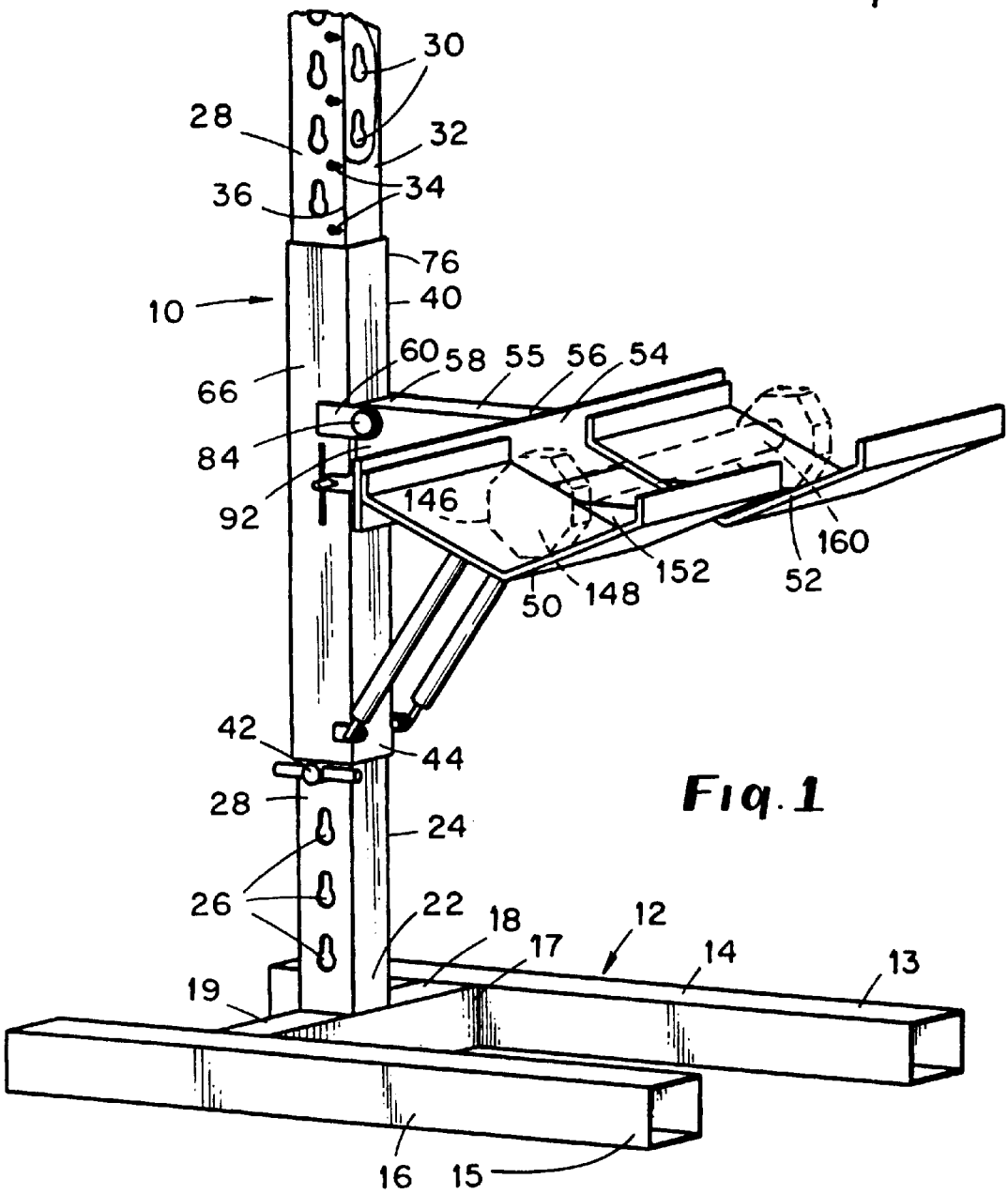
FIG. 1 is a representation of one embodiment of an apparatus embodying various of the features of the present invention and depicting a dumbbell cradled thereon.
Figure 3:
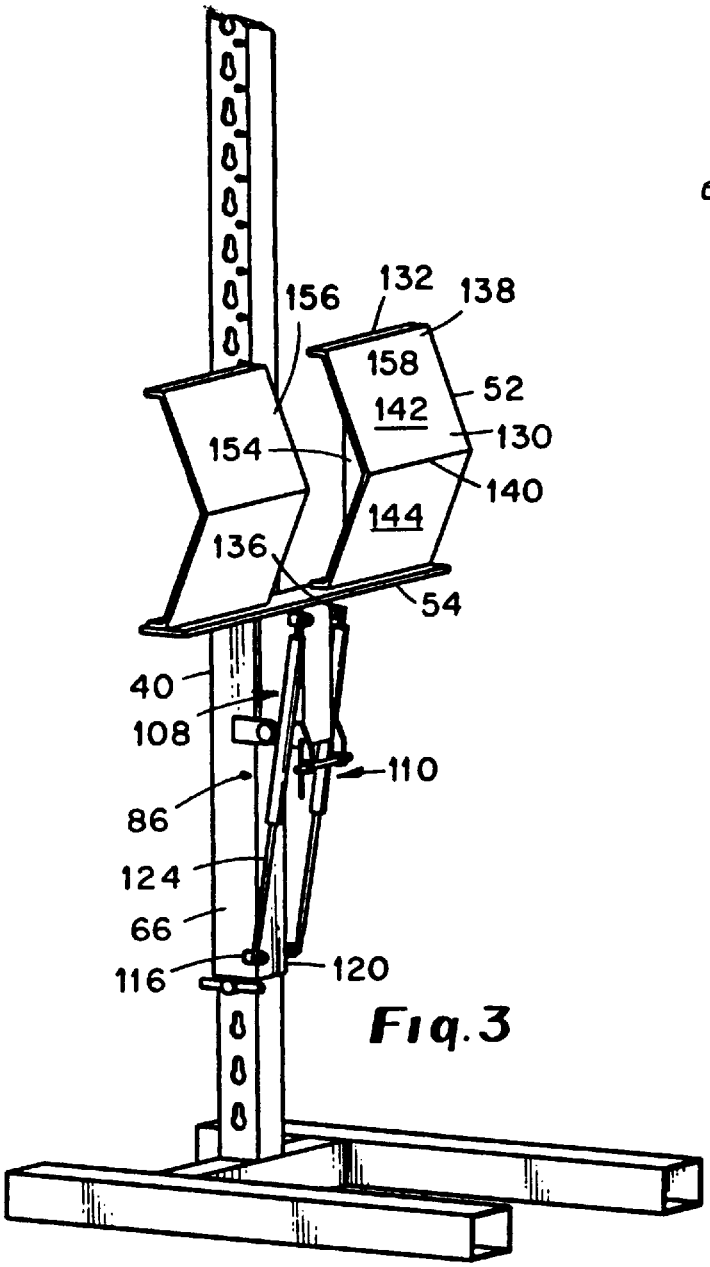
FIG. 3 is a representation of the rack depicted in FIG. 1 and showing the position of the cradles when the dumbbell is removed from the cradles.
Figure 4:
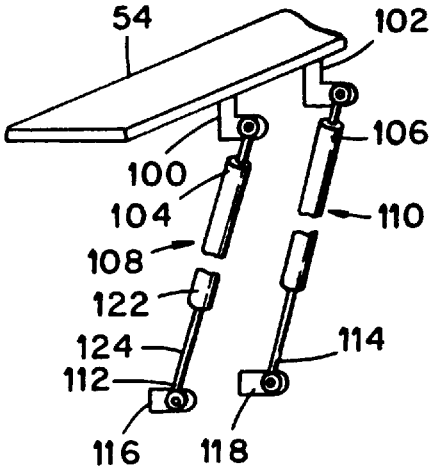
FIG. 4 is a fragmentary view of the apparatus of FIG. 3 and depicting details of a pair of gas springs mounted to the cradle mounting.

With reference to FIG. 1, in one embodiment, the present apparatus 10 comprises a base 12 formed, in the depicted embodiment, by first and second elongated base members 14 and 16, such as metal tubes, which are joined in parallel spaced-apart relationship as by means of a cross base member 18. Approximately midway between the opposite ends 17 and 19 of the top surface 20 of the cross member 18 there is anchored one end 22 of an upstanding rigid standard 24. The depicted standard is of rectangular, preferably square, cross-section and may be formed from a length of a metal tube having a wall thickness of about ¼ inch and a side wall dimension of about 2½ inches. As depicted, the standard 24 extends vertically upwardly from the cross member 18. In the depicted embodiment, a plurality of through openings 26 are provided through the thickness of one side wall 28 of the standard and a further plurality of registering through openings 30 are provided through the thickness of the opposite side wall 32 of the standard. These openings 26 and 30 preferably are aligned vertically and approximately midway of the width dimension of their respective side walls 28 and 32 and are spaced apart vertically by uniform distances. A further plurality of through openings 34 are provided adjacent the margin 36 of the side wall 28 and extend through the thickness of this side wall. These further through openings 34 are also aligned vertically and are spaced apart vertically by uniform distances. In a preferred embodiment, the vertical spacing between the openings 25, 30 and 34 are equal.

A sleeve 40 of abbreviated length relative to the standard is provided in encompassing relationship to the outer perimeter of the standard 24 such that the sleeve is slidably positionable at any of a large number of positions along the length dimension of the standard. Once the sleeve is positioned at a desired location along the length of the standard, a pin 42 is inserted into a registered pair of the openings 26 and 30 that are disposed adjacent the lowermost end 44 of the sleeve when the sleeve is in its desired location along the length of the standard, to limit further downward movement of the sleeve.

In lieu of through openings, any type of receptacle, such as a blind bore or the like, may be employed so long as there can be removably inserted therein a pin or like means for limiting the downward movement of a sleeve 40 once its position along the length of the standard has been selected.

The sleeve 40 carries thereon a pair of cradles 50 and 52 that are mirror images of one another and are interconnected by a cross member 54. The cross member 54, hence the cradles 50 and 52, are hingedly mounted to the sleeve as by a rigid arm 55, one end 56 of which is fixedly secured to the cross member 54 and the other end 58 thereof, which includes a through opening 59, is hingedly mounted to the sleeve as by means of first and second lugs 60 and 62 and a hinge pin 84. One lug 60 is fixedly mounted at one of its ends 64 to one outer side wall 66 of the sleeve and projects generally horizontally therefrom. The outboard end 70 of the lug 60 is provided with a through opening 72. The second lug 62 is fixedly mounted at one of its ends 74 to an opposite outer side wall 76 of the sleeve and projects therefrom parallel to the first lug 60. The outboard end 78 of the second lug 62 is also provided with a through opening 80 which is in register with the through opening 72 in the end 70 of the first lug 60. The outboard ends 70 and 78 of the lugs 60 and 62 are spaced apart from one another by a distance sufficient to receive therebetween the inboard end 58 of the cross member 54. With the through opening 59 in the inboard end of the arm 55 in register with the through openings 72 and 80 in the lugs 60 and 62, the hinge pin 84 in inserted through these registered openings to hingedly mount the arm 55, hence the cradles, to the sleeve.

The side wall 66 of the sleeve is provided with a through opening 86 which is in register with one of the plurality of through openings 34 in the wall 28 of the standard when the sleeve is held in its selected location along the length of the standard by the pin 42. This registration relationship of the openings 86 and 34 to the opening 26 in the standard is made possible by reason of the identical vertical spacing between the openings 34 and 36 in the standard and the selected vertical separation distance of the opening 86 through the sleeve wall from the lower end 44 of the sleeve. That is, the vertical distance from the lower end 44 of the sleeve to the opening 86 is substantially a multiple of the vertical spacing between adjacent ones of the openings 26. Accordingly, when the sleeve is "docked" by the pin 42 at any given vertical level along the standard, the opening 86 in the sleeve wall will be in register with one of the openings 34 in the side wall of the standard.

On the side wall 90 of the arm 55 and adjacent the inboard end 58 of the arm, there is provided a locking lug 92 that is anchored to the arm and projects therefrom past the inboard end of the arm and along the side wall 66 of the sleeve in covering relationship to the through opening 86 in the side wall of the sleeve. The outboard end 94 of the locking lug 92 is provided with a through opening 96 which may be positioned in register with the through opening 86 in the side wall 66 of the sleeve, hence in register with one of the openings 34 in the standard, when the arm 55 is in the desired horizontal attitude for positioning the cradles in their extended presentation attitude to receive and support a dumbbell therein. A locking pin 98 is provided for insertion in the registered through openings 96, 86 and 34, to lock the arm against hinged movement relative to the sleeve. By this means, the pin 98 further functions to provide added assurance of nonmovement of the sleeve along the length of the standard so long as the pin inserted in these openings. When the locking pin 98 is removed, the arm is free to swing about its hinge pin 84.

In the depicted embodiment, the cross member 54 is provided with first and second mounting lugs 100 and 102 that project therefrom and pivotally receive respective ends 104 and 106 of first and second gas springs 108 and 110. The opposite ends 112 and 114 of the gas springs are pivotally connected to respective mounting lugs 116 and 118 which are anchored to the opposite side walls 66 and 120 of the sleeve 40 and project therefrom to receive the respective ends 116 and 118 of the gas springs. Suitable gas springs are those available from Stabilus of Colmar, Pa. and known as LIFT-O-MAT™ Part No. 752819. Each of these gas springs comprises a hollow cylindrical body 122 within which there is reciprocatably mounted a piston member 124. Internally of the cylindrical body there is provided a gas under pressure which acts to bias the piston member toward an extended position relative to the cylindrical body. The volume of gas contained within the cylindrical body is sufficient to develop a pressure within the body that will urge the piston toward an extended position when there is no dumbbell residing in the cradles 50 and 52. When a dumbbell is disposed in the cradles, the combined weight of the dumbbell and the cradles and their mounting is sufficient to overcome the pressure within the cylindrical body and thereby cause the piston to be urged to its retracted position within the cylindrical body. The effective distance between the lugs 100 and 102 on the cross member 54 and the mounting lugs 116 and 118 on the side walls of the sleeve is chosen such that the overall length of each gas spring when the piston is in its most retracted position will limit the hinged movement of the cradles downwardly so that the cradles will assume a substantially horizontal attitude for the receipt and support of a dumbbell. The pressurized gas contained within the cylindrical body of each gas spring biases their respective piston member toward an extended position of the piston. Thus, the gas spring(s) bias the empty cradles to a substantially vertical out-of-the-way attitude adjacent the standard 24.

Figure 5:
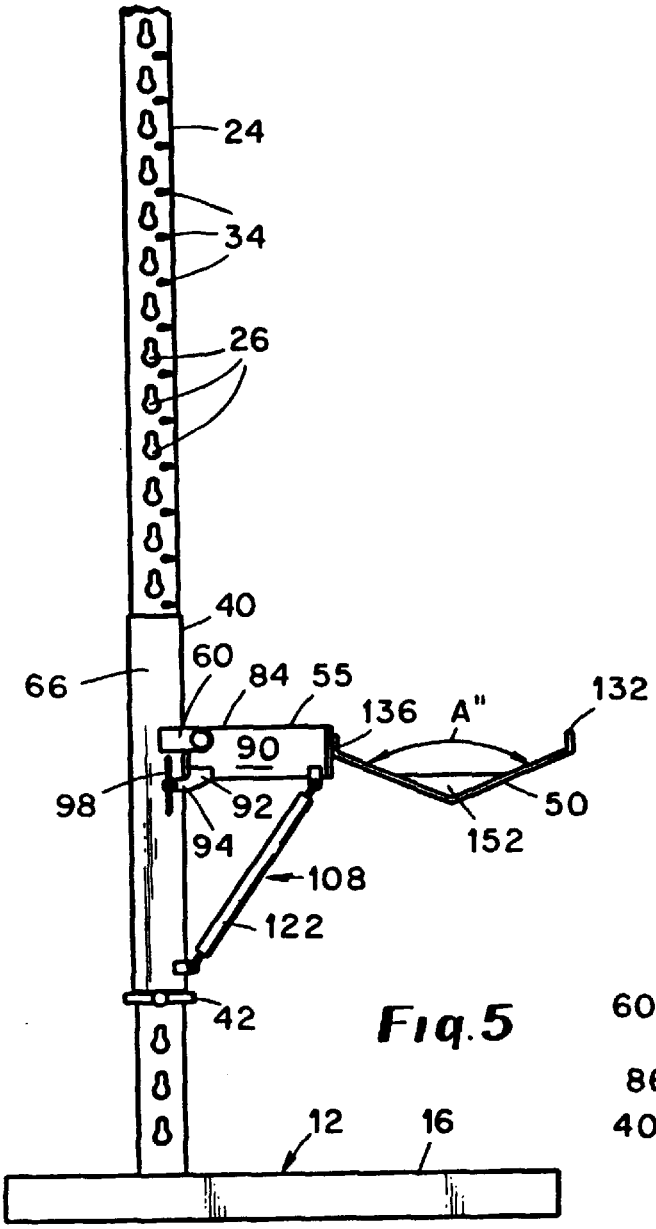
FIG. 5 is side elevational view of the rack depicted in FIG. 1 and depicting the cradles in their extended positions.
Figure 6:
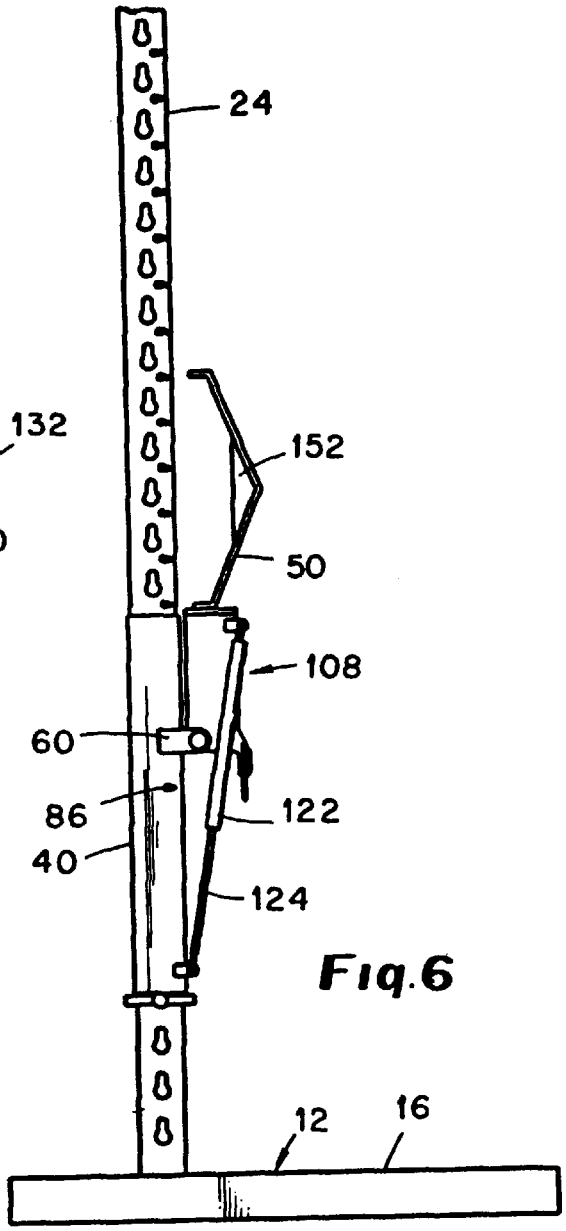
FIG. 6 is a side elevational view of the rack depicted in FIG. 1 and depicting the cradles in their retracted positions.
Figure 7:
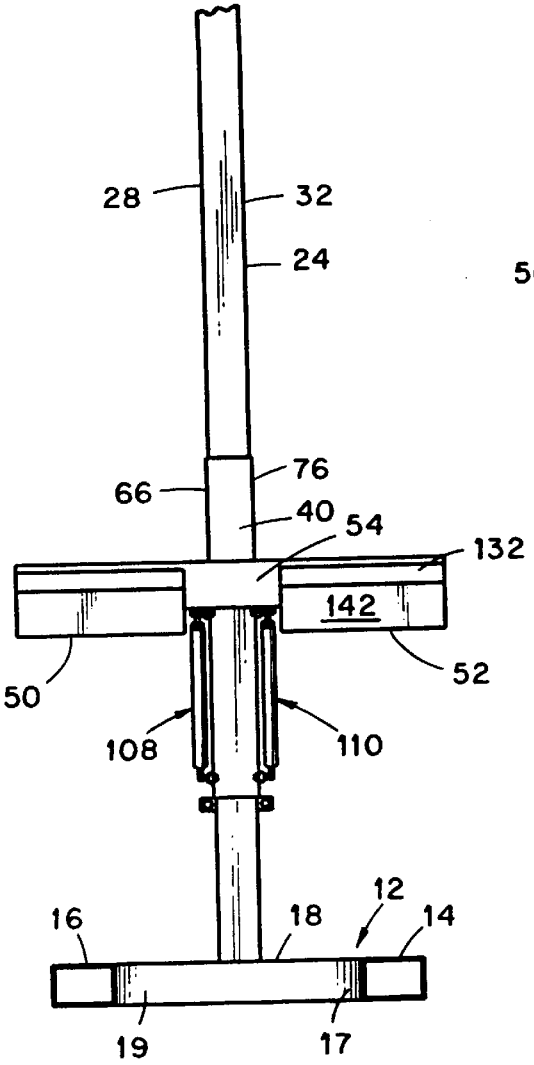
FIG. 7 is a front elevational view of the rack depicted in FIG. 5.
Figure 8:
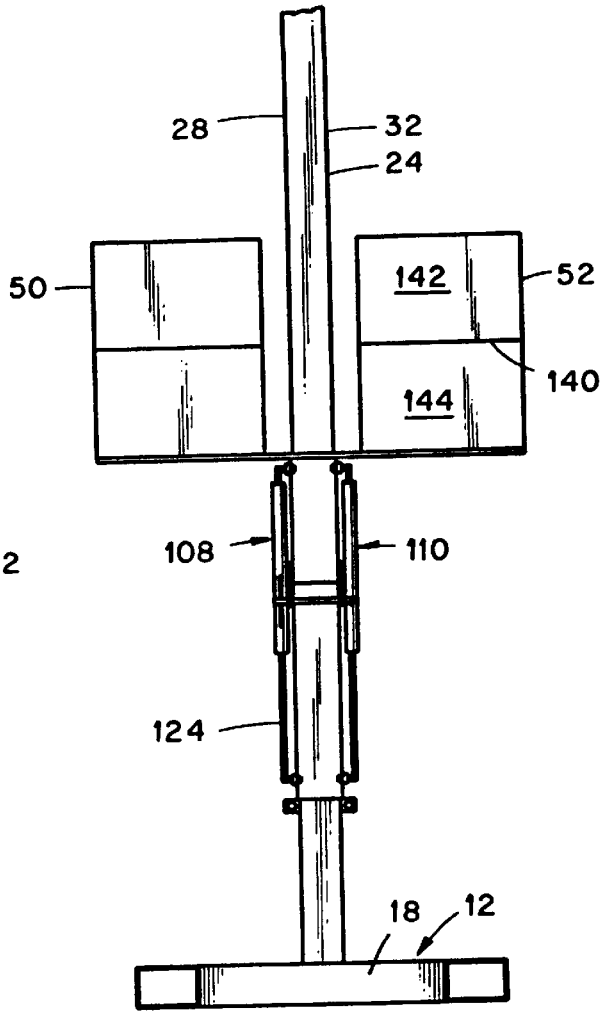
FIG. 8 is a front elevational view of the rack depicted in FIG. 6.
Figure 9:
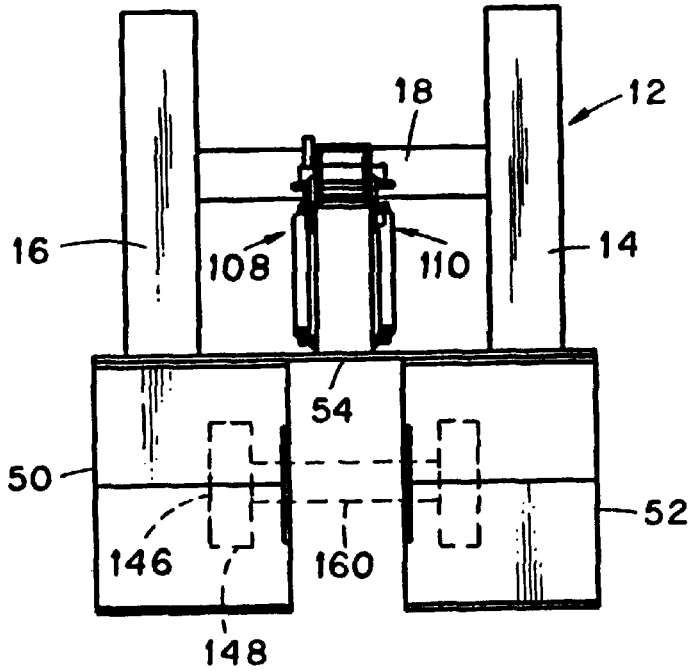
FIG. 9 is a top view of the rack depicted in FIG. 5.
Figure 10:
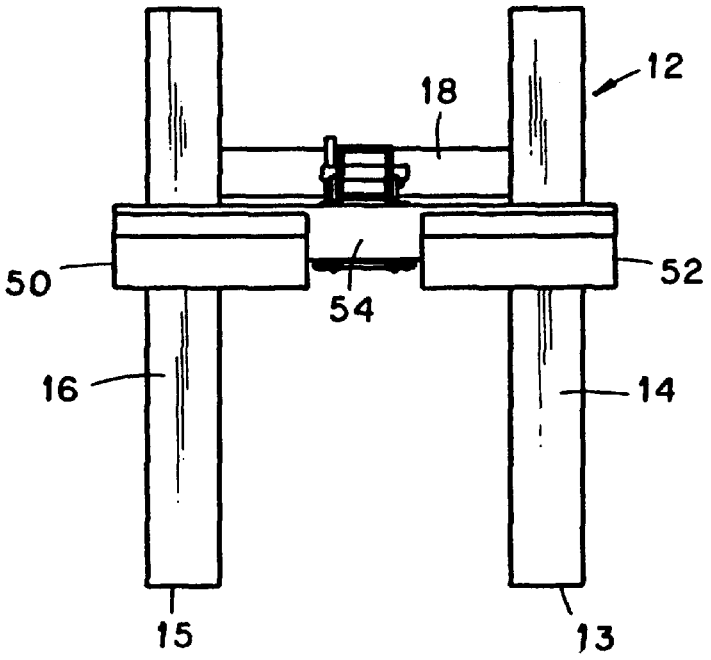
FIG. 10 is a top view of the rack depicted in FIG. 6

Each cradle in a preferred embodiment includes a generally planar body member 130 which includes a first upstanding margin 132 at the outboard end 134 thereof and a second upstanding margin 136 at the inboard end 138 thereof. The first upstanding margin 132 serves to prevent inadvertent movement of a dumbbell from the cradles, and the second upstanding margin 136 serves as a locus for joining the cradle to the cross member 54 as by welding or the like. Each cradle is bent about its transverse centerline 140 at an angle "A" of about 45 degrees so that those portions 142 and 144 of the body member on opposite sides of the bend, flare upwardly and outwardly (as viewed in FIGS. 1 and 5) to accept one end 146 of a dumbbell 148 therein. The second cradle is essentially identical to the first cradle, preferably is a mirror image thereof, and is disposed in planar alignment and spaced apart relationship to the first cradle. Each of the cradles is further provided with a gusset member 152 and 154, respectively, mounted on the inside edges 156 and 158, respectively, of the cradles to provide strength to the cradles and to aid in ensuring proper positioning of a dumbbell with one of its opposite enlarged ends in each of the cradles, thereby aiding in even distribution of the weight of the dumbbell between the two cradles and ensuring that the bar 160 of the dumbbell spans the distance between the two cradles. The distance between the inside edges 156 and 158 of the two cradles is chosen to be sufficient to permit the passage therebetween of a hand of the user for grasping the bar of the dumbbell to remove the dumbbell from its cradles.

In use of the rack of the present invention, the sleeve 40 is slid along the length of the standard 24 to a desired height at which a dumbbell is desirably held. When performing an exercise routine while standing, the height of the sleeve, hence the height of the cradles will be selected to support a dumbbell at about chest height. When performing an exercise routine while reclining on an exercise bench (user lying on their back on the bench), the height of the cradles will be adjusted to about the height of the reclining user's chest. Once in the desired position along the length of the standard, the sleeve is secured in this position by insertion of the pin 42. Thereupon, the cradles are pulled downwardly until the through opening 96 in the locking lug 92 is in register with a through opening 34 in the wall of the standard and the locking pin 98 in inserted in these registered through openings to lock the cradles in a substantially horizontal attitude.

Thereupon, a dumbbell is placed in the cradles with one end of the dumbbell resting in one of the cradles and the other end of the dumbbell resting in the other of the cradles and with the bar element of the dumbbell spanning the space between the adjacent cradles and in position to be grasped by the user. Once the dumbbell is resting in the cradles, the locking pin 98 is withdrawn. This action leaves the cradles free to rotate about the hinge pin 84 under the influence of the bias applied by the gas spring, when the dumbbell is removed from the cradles.

To commence an exercise routine using the dumbbell, the user grasps the bar 160 of the dumbbell and lifts the dumbbell out of the cradles. By reason of the preselected height of the cradles, the dumbbell may be simply "rolled" out of the cradles in a direction away from the standard 24. Thereupon the cradles swing upwardly and toward the standard, and away from the user who is then free to complete their exercise routine with the free dumbbell without concern for contact with the cradles and their supporting structure. Upon completion of the exercise routine, the user merely drops the dumbbell onto the floor.

Commonly, exercise routines call for the use of a dumbbell in each hand of the user. To this end, one apparatus in accordance with the present invention may be positioned on one side of the user and a second apparatus may be positioned on the opposite side of the user with a dumbbell being held in each apparatus. For this and similar reasons, the present apparatus is most advantageously portable and relatively easily moved about. Further, the positioning of the sleeve along the length of the standard is simple and certain. Further, the use of gas springs for providing the biasing of the cradles toward an upward and inward position relative to the standard results in the relatively slow movement of the cradles out of the operating field of the user, as opposed to the use of a spring or the like to provide this bias.

Whereas the present invention has been described in specific terms with respect to the structural features thereof, it will be recognized by one skilled in the art, given the present disclosure, that equivalent structure may be employed to obtain like results. For example, the standard 24 may be of a circular or elliptical cross-section, with the sleeve having a like cross-section. Also, whereas gas springs are preferred for providing the bias force for urging the cradles toward an out-of-the-way position when no dumbbell is present in the cradles because of the ability of gas springs to provide controllable rates of movement of the cradles, other means providing this bias may be employed. Further, any of several suitable structures may be employed to ensure retention of the sleeve at a selected position along the length of the standard such as friction devices, or to lock the cradles against hinged movement, for example.

Apparatus for mounting a dumbbell at a height in position for grasping at the commencement of an exercise routine without expending energy to lift the dumbbell to such height for commencement of the exercise routine including at least one cradle biased toward an out-of-the-way position relative to the operating field of the user, preferably employing one or more gas springs. The weight of the dumbbell disposed in the cradle overcomes the bias to maintain the cradle in a substantially horizontal attitude for presentation of the dumbbell to the user. Preferably two spaced apart cradles are employed, one cradle receiving one end of the dumbbell and the other cradle receiving the other end of the dumbbell with the bar element of the dumbbell spanning an open space between the adjacent cradles.

Whereas the present invention has been described in specific terms with respect to the structural features thereof, it will be recognized by one skilled in the art, given the present disclosure, that equivalent structure may be employed to obtain like results. For example, the standard 24 may be of a circular or elliptical cross-section, with the sleeve having a like cross-section. Also, whereas gas springs are preferred for providing the bias force for urging the cradles toward an out-of-the-way position when no dumbbell is present in the cradles because of the ability of gas springs to provide controllable rates of movement of the cradles, other means providing this bias may be employed. Further, any of several suitable structures may be employed to ensure retention of the sleeve at a selected position along the length of the standard such as friction devices, or to lock the cradles against hinged movement, for example.

What is claimed:

1. Apparatus for storing and presentation of a dumbbell, having opposite ends and a bar member joining the ends, to a user at a height commensurate with the desired height at which the user desires to commence an exercise routine employing the dumbbell comprising an upright standard supported above a supporting surface, a sleeve disposed in encompassing relationship to the perimeter of said standard and being slidably positionable to any of several spaced apart locations along the length of said standard, means for securing said sleeve in a selected location along the length of said standard, a pair of cradles hingedly mounted on said sleeve for hinged movement between a substantially horizontal dumbbell presentation attitude and a substantially vertical out-of-the-way attitude, said cradles being disposed in spaced-apart relationship to one another by a distance which can be spanned by the bar member of the dumbbell and defining an open space therebetween that is sized for the receipt of a user's hand therein, means biasing said cradles toward their substantially vertical out-of-the-way attitude when no dumbbell is present in said cradles.

2. The apparatus of claim 1 wherein said cradles are substantially mirror images of one another.

3. The apparatus of claim 1 wherein said means biasing said cradles comprises at least one gas spring including opposite ends, one of which is pivotally anchored to said cradles and the other of which is pivotally anchored to said sleeve.

4. The apparatus of claim 1 wherein said means for securing said sleeve in a selected location along the length of said standard includes a plurality of receptacles spaced apart along the length of said standard, said receptacles being suitable for the receipt therein of a pin which secures said sleeve in its selected position relative to the standard.

5. The apparatus of claim 4 wherein said receptacles are spaced apart by equal distances.

6. The apparatus of claim 4 and including a further plurality of receptacles spaced apart by equal distances from one another along the length of said standard, and further including locking means receivable within at least one of said further plurality of receptacles for locking said cradles against hinged movement thereof.

7. The apparatus of claim 1 wherein said cradles of said pair of cradles are interconnected to provide for simultaneous and equal movement of both cradles during hinged movement of either cradle.

8. Apparatus for storing and presentation of a dumbbell, having opposite ends and a bar member joining the ends, to a user at a height commensurate with the desired height at which the user desires to commence an exercise routine employing the dumbbell comprising an upright standard supported above a supporting surface, a sleeve disposed in encompassing relationship to the perimeter of said standard and being slidably positionable to any of several spaced apart locations along the length of said standard, means for securing said sleeve in a selected location along the length of said standard, a pair of cradles hingedly mounted on said sleeve for hinged movement between a dumbbell presentation attitude and an out-of-the-way attitude, said cradles being disposed in spaced-apart relationship to one another by a distance which can be spanned by the bar member of the dumbbell and defining an open space therebetween that is sized for the receipt of a user's hand therein, at least one gas spring including opposite ends, one of which is pivotally anchored to said cradles and the other of which is pivotally anchored to said sleeve biasing said cradles toward their out-of-the-way attitude when no dumbbell is present in said cradles.

9. The apparatus of claim 8 wherein said means for securing said sleeve in a selected location along the length of said standard includes a plurality of receptacles spaced apart along the length of said standard, said receptacles being suitable for the receipt therein of a pin which secures said sleeve in its selected position relative to the standard, and including a further plurality of receptacles spaced apart by equal distances from one another along the length of said standard, and further including locking means receivable within at least one of said further plurality of receptacles for locking said cradles against hinged movement thereof.

* * * * *